US012371988B2

(12) United States Patent
Han et al.

(10) Patent No.: US 12,371,988 B2
(45) Date of Patent: Jul. 29, 2025

(54) SYSTEM AND METHOD FOR DETERMINING A DIRECTION FOR DRILLING A WELL

(71) Applicant: ARAMCO SERVICES COMPANY, Houston, TX (US)

(72) Inventors: Yanhui Han, Houston, TX (US); Kaiming Xia, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 574 days.

(21) Appl. No.: 17/644,697

(22) Filed: Dec. 16, 2021

(65) Prior Publication Data

US 2023/0193744 A1 Jun. 22, 2023

(51) Int. Cl.
*E21B 7/04* (2006.01)
*E21B 44/00* (2006.01)
(Continued)

(52) U.S. Cl.
CPC ..... *E21B 47/022* (2013.01); *E21B 7/046* (2013.01); *E21B 44/00* (2013.01); *E21B 47/06* (2013.01);
(Continued)

(58) Field of Classification Search
CPC ..... E21B 47/022; E21B 7/046; E21B 44/00; E21B 47/06; E21B 49/003; E21B 2200/20; E21B 7/04
See application file for complete search history.

(56) References Cited

U.S. PATENT DOCUMENTS 7,555,414 B2 6/2009 Calhoun et al.
8,447,579 B2 5/2013 Sayers et al.
(Continued)

FOREIGN PATENT DOCUMENTS

CA 2697210 A1 * 9/2010 ..... E21B 43/025
CN 109555515 A 4/2019
CN 114635684 A * 6/2022

OTHER PUBLICATIONS

Zhang et al. "On drilling directions for optimizing horizontal well stability using a dual-porosity poroelastic approach", Jul. 2004 (Year: 2004).*
(Continued)

*Primary Examiner* — Eyob Hagos
(74) *Attorney, Agent, or Firm* — Osha Bergman Watanabe & Burton LLP

(57) ABSTRACT

A system for determining a direction for drilling a well is disclosed. The system has a device in a portion of a conveyance mechanism comprising a cylindrical housing with at least one sensor that tracks a position of the portion during a drilling operation, the device being configured to obtain a plurality of drilling parameters, and a control system coupled to the device and configured to perform at least one reservoir simulation, and prepare a plurality of required parameters while drilling. The device uses an optimization box to simulate increasing an angle between a drilling direction and a maximum horizontal stress by calculating a minimum mud pressure required to prevent borehole collapse. The control system generates an engineering curve representative of each angle simulated and a corresponding mud weight or pressure, and the device and the control system identify an optimal direction corresponding to a minimum drilling mud pressure parameter.

14 Claims, 8 Drawing Sheets

(51) Int. Cl.
*E21B 47/022* (2012.01)
*E21B 47/06* (2012.01)
*E21B 49/00* (2006.01)

(52) U.S. Cl.
CPC ..... *E21B 49/003* (2013.01); *E21B 2200/20* (2020.05)

(56) References Cited

U.S. PATENT DOCUMENTS

| | | | | |
|---|---|---|---|---|
| 9,249,654 | B2 | 2/2016 | Strachan et al. | |
| 9,863,241 | B2 | 1/2018 | Shen | |
| 9,970,266 | B2 | 5/2018 | Marx et al. | |
| 10,416,024 | B2 | 9/2019 | Turner et al. | |
| 2015/0090498 | A1* | 4/2015 | Hareland | E21B 45/00 175/48 |
| 2015/0168597 | A1* | 6/2015 | Bai | G01V 99/00 703/10 |
| 2018/0334903 | A1* | 11/2018 | Lehr | E21B 33/12 |
| 2018/0371901 | A1 | 12/2018 | Lakings et al. | |
| 2019/0226336 | A1 | 7/2019 | Benson et al. | |
| 2020/0102822 | A1* | 4/2020 | Alvarellos Iglesias | E21B 47/08 |
| 2021/0048382 | A1 | 2/2021 | Badri et al. | |
| 2021/0062644 | A1 | 3/2021 | Macpherson | |
| 2021/0254458 | A1* | 8/2021 | Camargo | E21B 49/003 |
| 2022/0136380 | A1* | 5/2022 | Kuckes | E21B 7/10 175/24 |

OTHER PUBLICATIONS

Zare-Reisabadi et al. "Determination of optimal well trajectory during drilling and production based on borehole stability", Aug. 2012 (Year: 2012).*

He et al. "Factors influencing wellbore stability during underbalanced drilling of horizontal wells e When fluid seepage is considered" (Year: 2015).*

Zare-Reisabadi, M.R. et al.; "Determination of optimal well trajectory during drilling and production based on borehole stability"; International Journal of Rock Mechanics and Mining Sciences, vol. 56, 2012, pp. 77-87 (11 pages).

Hayavi, M.T. et al.; "Determination of Safe Mud Pressure Window for Different Well Trajectories and Stress Regimes During Drilling Operations"; Geomechanics for Energy and the Environment, vol. 12, Aug. 8, 2017, pp. 14-20 (28 pages).

Zhang, J. et al.; "On Drilling Directions for Optimizing Horizontal Well Stability Using a Dual-porosity Poroelastic Approach"; Journal of Petroleum Science and Engineering, vol. 53(1-2), Mar. 10, 2006, pp. 61-76 (16 pages).

* cited by examiner

SYSTEM AND METHOD FOR DETERMINING A DIRECTION FOR DRILLING A WELL

BACKGROUND

In current drilling practices, underbalanced coiled tubing drilling allows for continuous drilling and pumping, which increases a rate of penetration, reduces formation damage and mud loss, and avoids pipe differential sticking. For underbalanced drilling, a pressure in a wellbore is lower than a pore pressure of a formation being drilled. In this situation, a main drilling issue is a borehole breakout or collapse, especially when a well is not drilled at an optimal direction. The optimal direction requires a minimum mud weight parameter to be met and current drilling practices drilled at the maximum horizontal stress direction actually fail to meet this minimum mud weight consistently.

SUMMARY

In general, in one aspect, embodiments disclosed herein relate to a system for determining a direction for drilling a well, including a device in a portion of a conveyance mechanism comprising a cylindrical housing with at least one sensor that tracks a position of the portion during a drilling operation, the device being configured to obtain a plurality of drilling parameters, and a control system coupled to the device and configured to perform at least one reservoir simulation, and prepare a plurality of required parameters while drilling, wherein the device uses an optimization box to simulate increasing an angle between a drilling direction and a maximum horizontal stress by calculating a minimum mud pressure required to prevent borehole collapse, wherein the control system generates an engineering curve representative of each angle simulated and a corresponding mud weight or pressure, and wherein the device and the control system identify an optimal direction corresponding to a minimum drilling mud pressure parameter.

In general, in one aspect, embodiments disclosed herein relate to a method for determining an optimal direction for drilling a horizontal well, involving obtaining, by a device, a plurality of drilling parameters, wherein the device is a portion of a conveyance mechanism comprising a cylindrical housing with at least one sensor that tracks a position of the portion during a drilling operation, preparing, by a control system, a plurality of required parameters while drilling, wherein the control system is coupled to the device and configured to perform at least one reservoir simulation, using, by the device, an optimization box to simulate an angle between a drilling direction and a maximum horizontal stress by calculating a minimum mud pressure required to prevent borehole collapse, generating, by the control system, an engineering curve representative of each angle simulated and a corresponding mud weight or pressure, and identifying, by the device and the control system, an optimal direction corresponding to a minimum drilling mud pressure parameter.

In general, in one aspect, embodiments disclosed herein relate to a non-transitory computer readable medium storing instructions executable by a computer processor, the instructions comprising functionality for obtaining a plurality of drilling parameters, preparing a plurality of required parameters while drilling, using an optimization box to simulate an angle between a drilling direction and a maximum horizontal stress by calculating a minimum mud pressure required to prevent borehole collapse, generating an engineering curve representative of each angle simulated and a corresponding mud weight or pressure, and identifying an optimal direction corresponding to a minimum drilling mud pressure parameter.

Other aspects of the disclosure will be apparent from the following description and the appended claims.

BRIEF DESCRIPTION OF DRA WINGS

Specific embodiments of the disclosed technology will now be described in detail with reference to the accompanying figures. Like elements in the various figures are denoted by like reference numerals for consistency.

DETAILED DESCRIPTION

Figure 1:
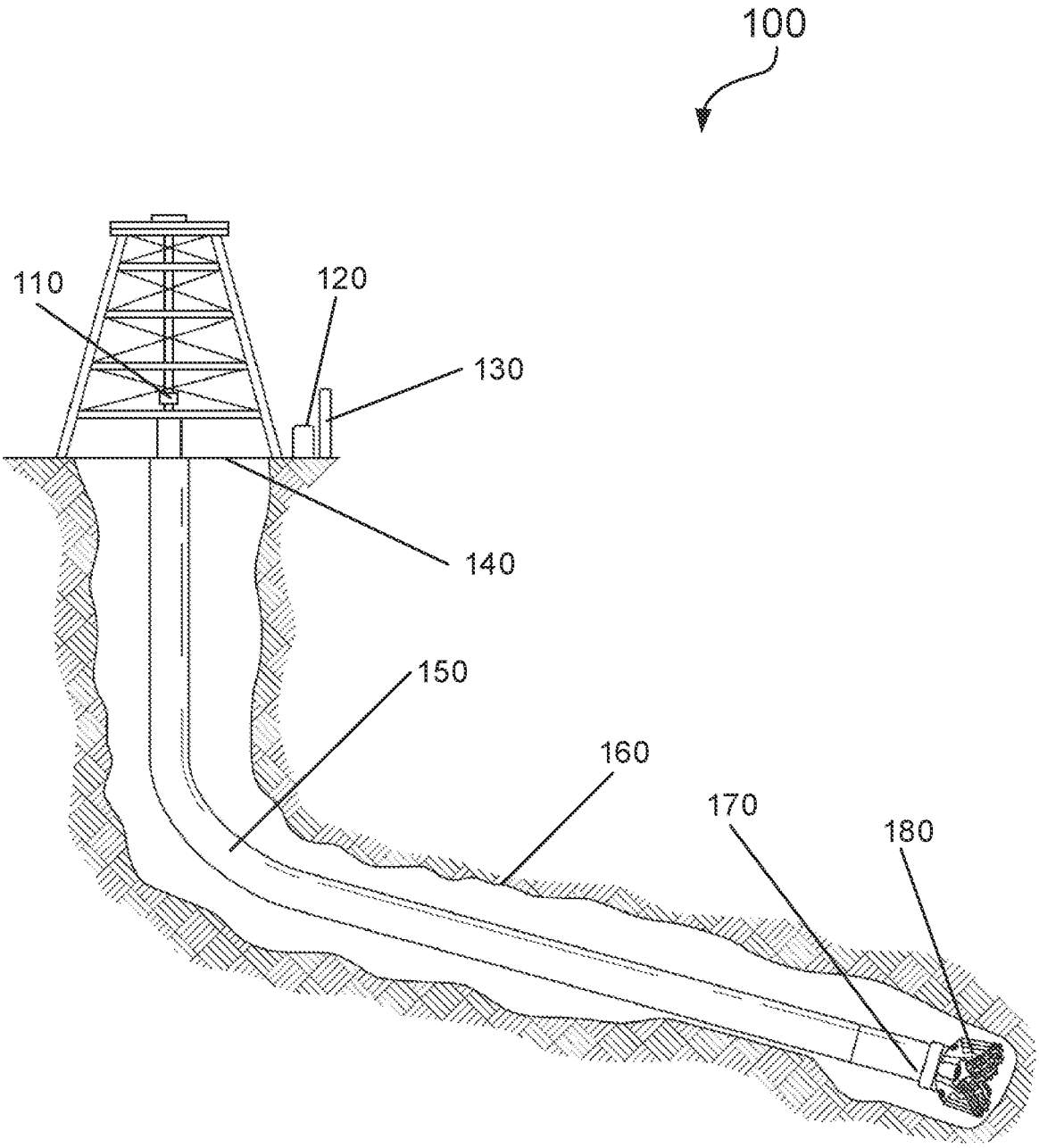
FIG. 1 shows a schematic diagram showing a system configured for drilling a well in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a system and a method for consistently determining an optimal direction for drilling a well. The system and the method provide the optimal direction during underbalanced coiled tubing drilling to allow for continuous drilling and pumping, which increases a rate of penetration and avoids pipe differential sticking. Further, the system and the method may be used, in one or more embodiments, to control the underbalanced coiled tubing drilling to minimize formation damage and to increase production. In this regard, the system and the method control drilling for certain reservoirs where the pressure in a wellbore is lower than a pore pressure of the formation being drilled. In this regard, the system and the method prevent borehole breakouts or collapses.

In some embodiments, the device is a drill stabilizer section that instructs a drill bit to drill at an optimal direction, which requires a minimum mud weight parameter to be met. The system may be an entire drilling assembly including the device. The method may be a process to use the device and the system to determine the optimal drilling direction for underbalanced drilling in a strike slip stress regime. The method may include preparing multiple required parameters while drilling. These input parameters may include various in-situ stress and pore pressure parameters including vertical stress, maximum and minimum horizontal stresses, pore pressure. In one or more embodiments, the input parameters may include rock mechanical properties such as a Poisson's ratio, an uniaxial compressive strength (UCS), and a Friction angle. Further, when drilling horizontal wells, the method may include increasing an angle between a drilling direction and a maximum horizontal stress by calculating a minimum mud pressure required to prevent borehole collapse, and recording this value as a collapse mud pressure (i.e., the mud weight parameter) for each drilling angle between 1 and 180 degrees. At this point, the system may generate an engineering curve of collapse mud pressures (i.e., mud weight parameters) versus 180 possible drilling angles. From the engineering curve, the system may identify an angle corresponding to a minimum drilling mud pressure parameter. This parameter may be selected as the optimal drilling direction that will provide the smallest probability of a borehole collapse.

The system and the method may rely on a strike-slip stress regime when drilling a horizontal well. More specifically, in one or more embodiments, the method may focus on meeting the conditions of a maximum horizontal stress $S_H$ being larger than a vertical stress $S_v$, which is in turn larger than a minimum horizontal stress $S_h$ (i.e., $S_H>S_v>S_h$).

In some embodiments, if there is hydraulic fracturing planned for well completion, the device may drill the well in the direction of minimum horizontal stress direction (using balanced and overbalanced drilling technology) so that transverse fractures may be generated in the hydraulic fracturing. Alternatively, in reservoirs with good permeability, if no hydraulic fracturing is planned for well completion, the device necessarily instructs the drill bit to drill in a direction close to the maximum horizontal stress $S_H$ direction using underbalanced drilling technology, aiming at minimizing a borehole collapse risk and maximizing the economic benefit. In other words, the device may drill the well at an angle deviating from the maximum horizontal stress direction to consistently reduce a chance of borehole breakout or collapse. For example, if no hydraulic fracturing is planned, underbalanced coiled tubing drill might be used, which should be drilled in a direction close (not exactly equal to) the maximum horizontal stress direction and requires the minimum mud weight and also avoids breakout or collapse.

While the following figures are described referencing a drilling direction in a horizontal direction, a person of ordinary skill in the art would readily understand that the system and the method may be implemented wells with both a vertical direction and a horizontal direction.

FIG. 1 shows an example of a device 170 being used to control a drilling direction of a drill bit 180 during drilling operations for a well 150 in a well system 100 in accordance to one or more embodiments. The well system 100 may include surface equipment including actuating devices 110, sensors 120, and a control system 130 connected to one another using hardware and/or software to create various interfaces. Further, the well system 100 may be propped by structures from a surface 140. The well system 100 includes the wellbore 160 extending from the surface 140 to an underground formation. The underground formation may have porous areas including hydrocarbon pools that may be accessed through the wellbore 160. In some embodiments, the device 170 is translated in a vertical direction and/or a horizontal direction along the wellbore 160 using the surface equipment and a conveyance mechanism.

In some embodiments, during drilling operations, the control system 130 may collect and record wellhead data for the well system 100. The control system 130 may include flow regulating devices that are operable to control the flow of substances into and out of the wellbore 160. For example, the control system 130 may include one or more production valves (not shown separately) that are operable to control the flow of fluids in the well system 100 during drilling operations. In some embodiments, the control system 130 may regulate the movement of the device 170 through the conveyance mechanism by modifying power supplied to the actuating devices 110.

The control system 130 may include a reservoir simulator (not shown). The reservoir simulator may include hardware and/or software with functionality for performing one or more strike-slip stress box and optimization box simulations. The strike-slip stress box simulation is an evaluation of a strike-slip stress regime. When drilling a horizontal well, the strike-slip stress regime focuses on meeting the conditions of a maximum horizontal stress $S_H$ being larger than a vertical stress $S_v$, which is in turn larger than a minimum horizontal stress $S_h$ (i.e., $S_H>S_v>S_h$). The optimization box simulation involves using multiple strike-slip stress box simulations for different drilling directions and determining an optimal direction for drilling. The reservoir simulator may perform production analysis and estimation based on one or more characteristics associated to the formation. And the direction of drilling of the well. These characteristics may include information associated to reservoir behavior to optimize production based on the analysis of core porosity, permeability, fluid saturation, grain density, lithology, and/or texture of the rock formation. Further, the reservoir simulator may include a memory for storing drilling logs and data regarding multiple engine-generated boxes for performing simulations. While the reservoir simulator may be included in the control system 130 at a well site, the reservoir simulator may be located away from the well site. In some embodiments, the reservoir simulator may include a computer system disposed to estimate a depth of the device 170 at any given time. The reservoir simulator may use the memory for compiling and storing historical data about the drilling operations.

In some embodiments, the actuating devices 110 may be motors or pumps connected to the device 170 and the control system 130. The control system 130 may be coupled to the sensors 120 to sense characteristics of substances and conditions in the wellbore 160, passing through or otherwise located in the well system 100. The sensors 120 may include a surface temperature sensor.

The device 170 may be a portion of the conveyance mechanism that is configured to retrieve at least one drilling parameter associated to the formation. The device 170 may include a cylindrical housing including at least one sensor that tracks the position of the portion during the drilling operation. In some embodiments, the device 170 is disposed immediately above the drill bit 180 to track a precise location of a center of the drill bit 180 during drilling operations.

In some embodiments, the measurements are recorded in real-time, and are available for review or use within seconds, minutes or hours of the condition being sensed (e.g., the measurements are available within 1 hour of the condition being sensed). In such an embodiment, the coring operations may be referred to as being performed "real-time." Real-time data may enable an operator of the well system 100 to assess a relatively current state of the well system 100, and make real-time decisions regarding drilling operations.

Figure 2:
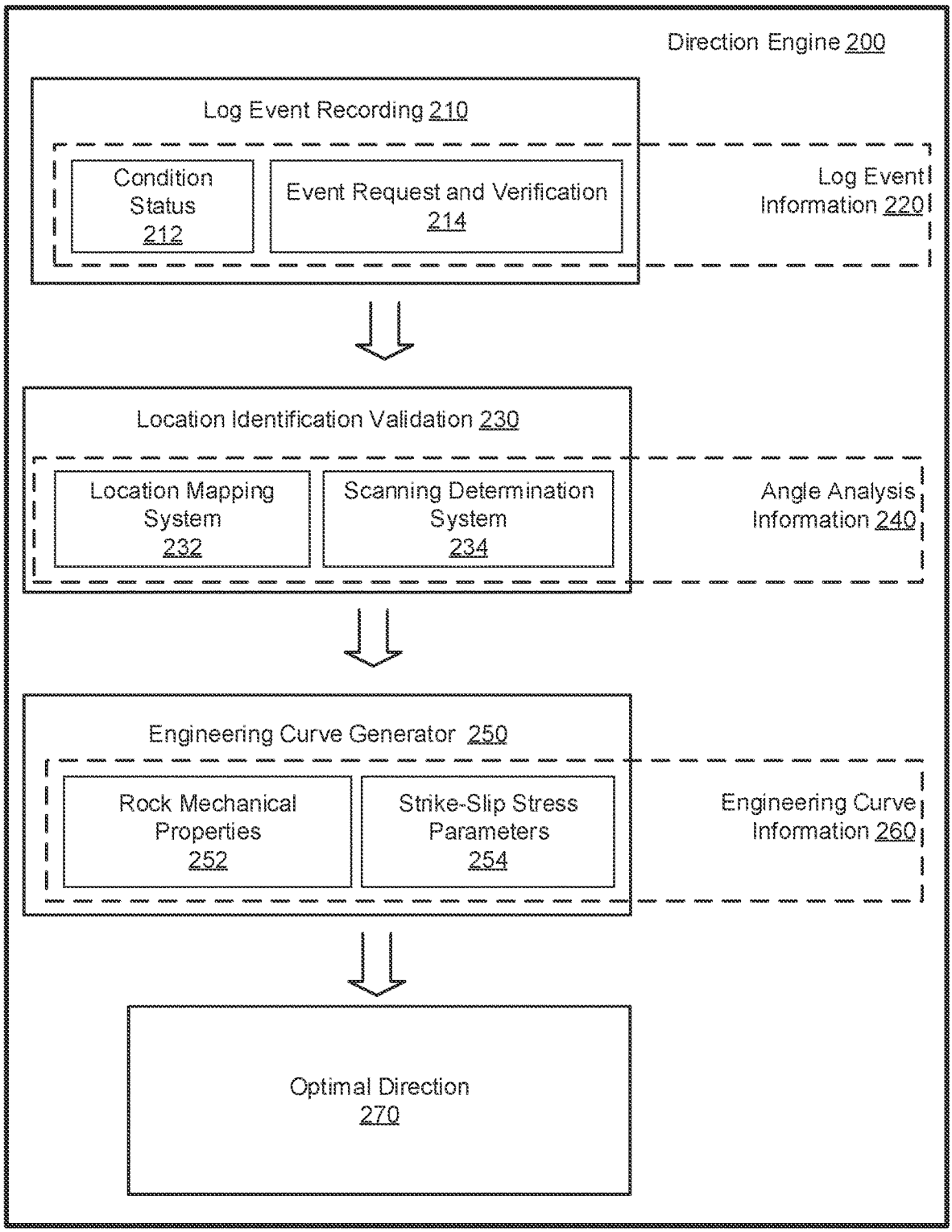
FIG. 2 shows a schematic diagram showing a direction engine for determining an optimal direction for drilling a well in accordance with one or more embodiments.

FIG. 2 shows a process for determining an optimal direction 270 for drilling a horizontal well using a direction engine 200. In one or more embodiments, the optimal direction 270 is based on various different levels of information and processing. Determining the optimal direction 270 may include using log event information 220, angle analysis information 240, and engineering curve information 250. The direction engine 200 may use any of the information included at any given time during operation in order to obtain the optimal direction 270. The various information may be processed and controlled by one or more of the components described in reference to FIG. 1.

In some embodiments, the direction engine 200 may perform one or more strike-slip stress box and optimization box simulations to identify an optimal direction for drilling. As noted above, an "optimal direction" is defined as a direction for drilling in which mud weight is minimum and the chance of borehole breakout or collapse is least likely to happen. In some embodiments, the mud weight and chance of borehole breakout or collapse are identified in an engineering curve that will be described in more detail in reference to FIGS. 3-6. In this regard, the engineering curve is generated in the process performed by the direction engine 200 to obtain the optimal direction 270.

The log event information 220 may be used after a log event recording 210 is triggered. The direction engine 200 may create, or obtain, an instruction indicating an area of interest anywhere on the rock formation based on a point of interest selected by a user or a decision-making server. In this context, a user is any person responsible for directly, or indirectly, triggering the log event recording 210. Further, a decision-making server is any entity that triggers the log event recording 210 directly by sending instructions that may be configured by a person or machine learning algorithm. In log event recording 210, the area of interest may be assessed through a condition status 212 and an event request and verification 214, which may provide raw information relating to the condition of the device 170 and its location in the wellbore 160 with respect to the area of interest.

The angle analysis information 240 may be used after a location identification validation 230 is triggered. The direction engine 200 may obtain angle analysis information 240 including one or more rock formation characteristics (i.e., rock mechanical properties such as elastic properties or inelastic properties) for any area of interest. The angle analysis information 240 may include rock formation characteristics for a specific drilling direction corresponding to a specific angle. The direction engine 200 may access angle analysis information 240 based on a specific combination of the condition status 212 and the event request and verification 214. The direction engine 200 may determine the location of the device 170 and the drill bit 180 via an location mapping system 232 and a scanning determination system 234. The direction engine 200 may use the location mapping system 232 to analyze drilling operation information of the selected area of interest to determine the relations and interconnections between historical data of the rock formation and data collected during the drilling operations. Further, the direction engine 200 may use the scanning determination system 234 to identify and categorize types of assets in the area of interest. The direction engine 200 may use the location identification validation 230 to test or simulate multiple possible angles for drilling the well 150. Assets may be any change in the structure of the rock formation along the area of interest.

The engineering curve information 260 may be used after an engineering curve generator 250 is triggered. The direction engine 200 may analyze the results of the location identification validation 230 and test the angle analysis information 240 in accordance with coring practices. The direction engine 200 may use rock mechanical properties 252 and strike-slip stress parameter 254 to determine an exact location of assets in the area of interest. In some embodiments, rock mechanical properties 252 and strike-slip stress parameter 254 include collection of various input parameters that may include various in-situ stress and pore pressure parameters including vertical stress, maximum and minimum horizontal stresses, pore pressure. Further, these input parameters may include rock mechanical properties such as a Poisson's ratio, an UCS, and a Friction angle.

The engineering curve generator 250 may determine an optimal direction for drilling by combining the engineering curve information 260 with multiple drilling parameters used in the angle analysis information 240. In some embodiments, the angle analysis information 240 may include results from simulating an increase of an angle between a drilling direction and a maximum horizontal stress by calculating a minimum mud pressure required to prevent borehole collapse, and recording this value as a collapse mud pressure (i.e., the mud weight parameter) for each drilling angle between 1 and 180 degrees. In this regard, the angle analysis information 240 is information that the engineering curve generator 250 relies on to generate an engineering curve of collapse mud pressures (i.e., mud weight parameters) with different possible drilling angles. From the engineering curve, the direction engine 200 may identify an angle corresponding to a minimum drilling mud pressure parameter and this angle may be selected as the optimal drilling direction that can avoid a borehole collapse simultaneously. In some embodiments, the direction engine 200 consistently outputs the optimal direction 270 because this is a direction determined using an angle that the direction engine 200 has determined to have the smallest mud weight and smallest chance of borehole breakout or collapse while performing the rest of the drilling operations.

Figure 3:
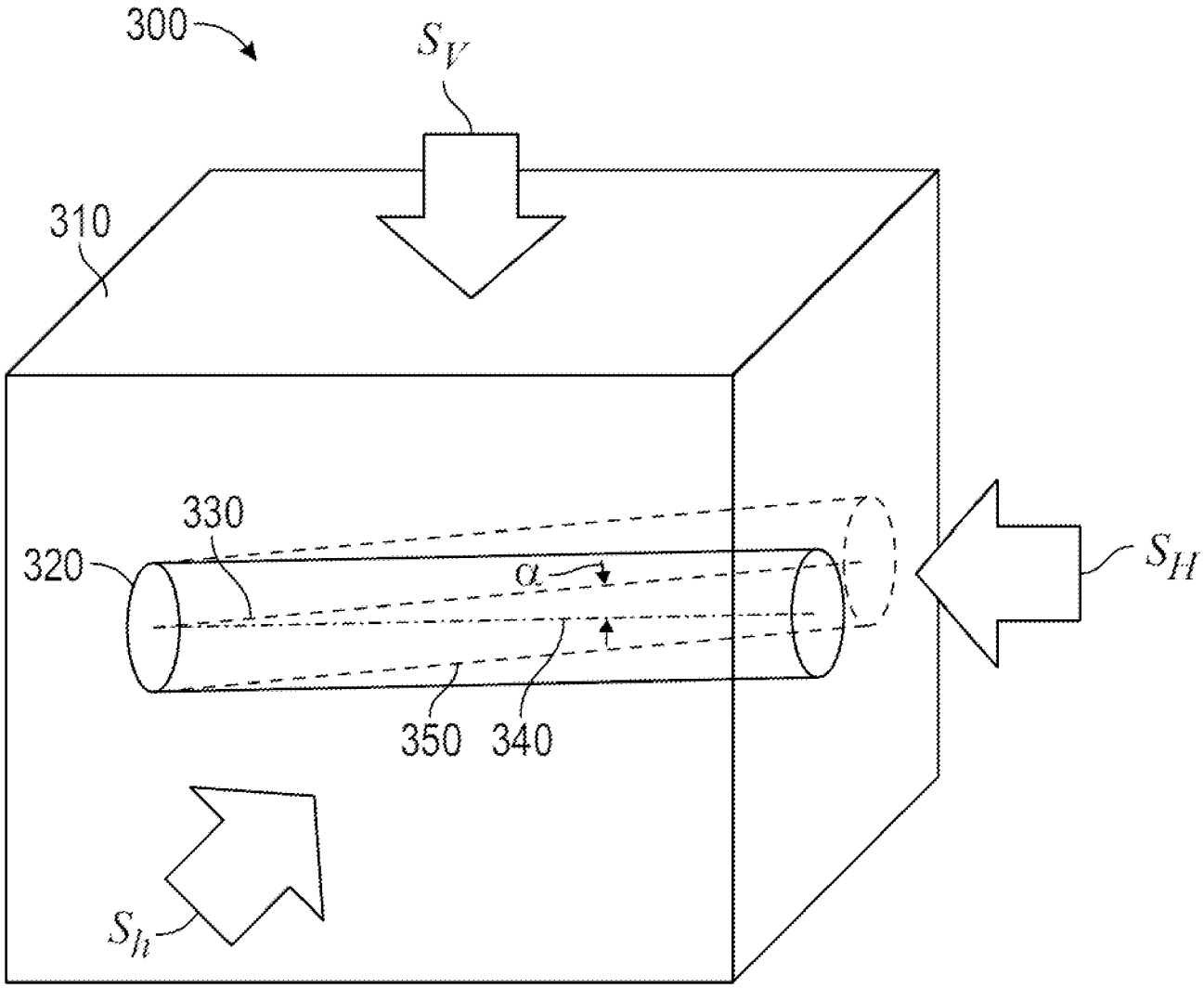
FIG. 3 shows a representation of a strike-slip stress box in accordance with one or more embodiments.

FIG. 3 shows a simulation 300 of a strike-slip stress box 310 generated by the direction engine 200 from resources and information collected using the device 170 in collaboration with the control system 130. The simulation 300 forms the strike-slip stress box 310 around the device 170 before deciding a new drilling direction to follow. The simulation 300 may be a virtual box used by the device 170 and the control system 130 to determine the new drilling direction. In one or more embodiments, the simulation 300 may be displayed in real time in a displaying device. In some embodiments, when drilling a horizontal well following a strike-slip stress regime (i.e., matching the conditions of $S_H>S_v>S_h$), the device 170 does not necessarily cause the drill bit 180 to continue drilling operations in the direction of maximum horizontal stress $S_H$. Instead, the device 170 identifies the optimal direction which is dependent on the maximum horizontal stress Sy and its azimuth, vertical stress $S_v$ and minimum horizontal stress $S_h$, pore pressure, and other reservoir parameters. The strike-slip stress box 310 is generated in real time by the device 170 to track a current position 320 and a current central axis 340. A purpose of the strike-slip stress box 310 is to estimate an angle change a between the current position 320 and the current central axis 340 with respect to a new position 350 and a new central axis 330, respectively.

Figure 4A:
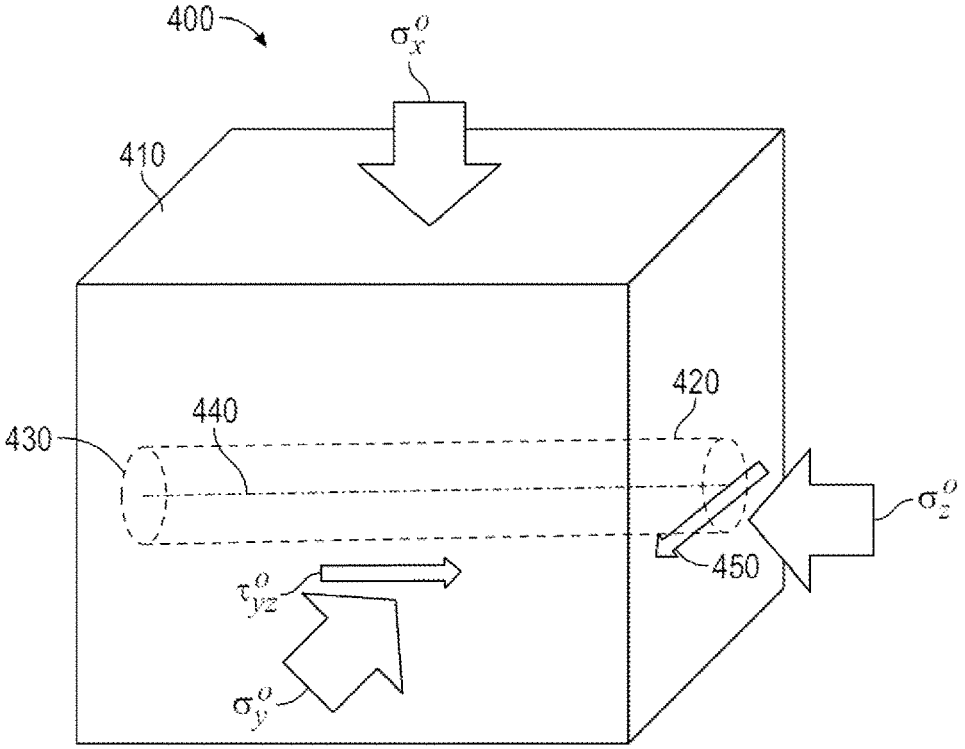
FIGS. 4A and 4B show a representation of a optimization box in accordance with one or more embodiments.
Figure 4B:
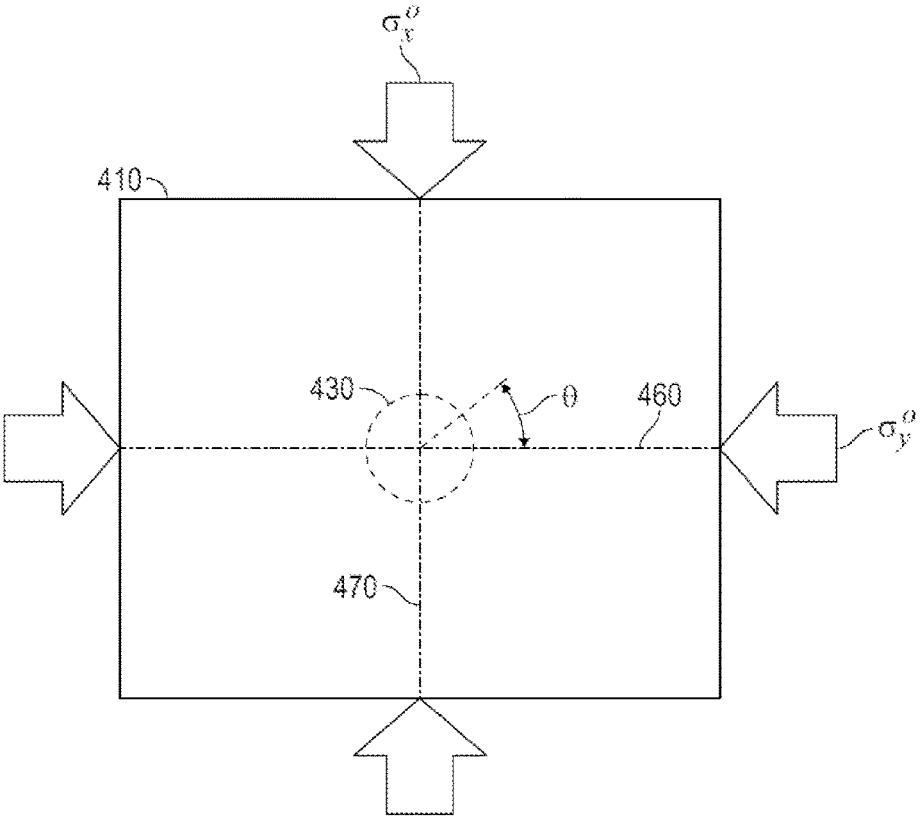

FIGS. 4A and 4B shows a simulation 400 of an optimization box 410 generated by the direction engine 200 from resources and information collected using the device 170 in collaboration with the control system 130. The simulation 400 forms the optimization box 410 around the device 170 before deciding the new drilling direction to follow. The simulation 400 may be a virtual box used by the device 170 and the control system 130 to determine the new drilling direction. In one or more embodiments, the simulation 400 may be displayed in real time in a displaying device. In some embodiments, the optimization box 410 uses the strike-slip stress box 310 as a starting point. The optimization box 410 assesses borehole collapse risk analysis by tracking stress distributions around the borehole. In some embodiments, the device 170 calculates in-situ stresses by transforming a borehole's local coordinate. As shown in FIGS. 4A and 4B, these transformed in-situ stresses $\sigma_x^o$, $\sigma_y^o$, $\sigma_z^o$, and $\tau_{yz}^o$ correspond to the changes on the vertical and horizontal stresses on a device in a position 420 with a central axis 440 and a circle 430. The transformed in-situ stresses $\sigma_x^o$, $\sigma_y^o$, $\sigma_z^o$, and $\tau_{yz}^o$ may be calculated as follow.

$$\sigma_x^o=\sigma_v \tag{1}$$

$$\sigma_y^o=\sin^2 a\, S_u+\cos^2 a\, S_h \tag{2}$$

$$\sigma_z^o=\cos^2 a\, S_H+\sin^2 a\, S_h \tag{3}$$

$$\tau_{yz}^o=-\sin a \cos a\, S_H+\sin a \cos a\, S_h \tag{4}$$

The parameter a is the angle a between a drilling direction and the maximum horizontal stress $S_H$; $\sigma_x^o$, $\sigma_y^o$, $\sigma_z^o$, and $\tau_{yz}^o$ are the transformed in-situ stresses in borehole local coordinates.

In FIGS. 4A and 4B, the stress on the borehole wall around the borehole in cylindrical coordinates can be calculated as follow.

$$\sigma_r=p_w \tag{5}$$

$$\sigma_\theta=\sigma_x^o+\sigma_y^o-2(\sigma_x^o-\sigma_y^o)\cos 2\theta-p_w \tag{6}$$

$$\sigma_z=\sigma_z^o-2v(\sigma_x^o-\sigma_y^o)\cos 2\theta \tag{7}$$

$$\tau_{\theta z}=2\tau_{yz}^o \cos\theta \tag{8}$$

The parameter $p_w$ is a wellbore fluid pressure; θ is a wellbore angle measured from $\sigma_y^o$; $\sigma_r$ is a radial stress; $\sigma_\theta$ is a tangential stress; $\theta_z$ is a axial stress; $\tau_{\theta z}$ is a shear stress on a θ-z plane.

A major principal stress component on the plane perpendicular to radial direction is be calculated as follow.

$$\sigma_1=\frac{\sigma_\theta+\sigma_z}{2}+\sqrt{\frac{(\sigma_\theta-\sigma_z)^2}{4}+\tau_{\theta z}^2} \tag{9}$$

The parameter $\sigma_1$ is also a function of the well azimuth a, the wellbore angle (θ), in addition to the in-situ stresses and pore pressures discussed above. For each a and θ, there is a critical mud pressure 450 (or, equivalently, mud weight) above which the major principal stress will become lower than the compressive strength of the rock as calculated below.

$$\sigma_1\leq N_\varphi\sigma_r+UCS \tag{10}$$

The parameter UCS is the uniaxial compressive strength of rock as calculated below.

$$UCS=\frac{2c\cos\varphi}{1-\sin\varphi} \tag{11}$$

The parameter φ is the friction angle of rock; c is the cohesive strength of rock. The parameter $N_\varphi$ is a function of friction angle as calculated below.

$$N_\varphi=\frac{1+\sin\varphi}{1-\sin\varphi} \tag{12}$$

In one or more embodiments, the simulation 400 calculates the optimal drilling direction for the central axis 440 places at a point of intersection of a vertical axis 470 and a horizontal axis 460. The drilling direction (i.e., borehole azimuth) that can minimize the borehole collapse risk with the lowest mud weight is calculated using parameters and information associated to the process followed by the direction engine 200.

Figure 5:
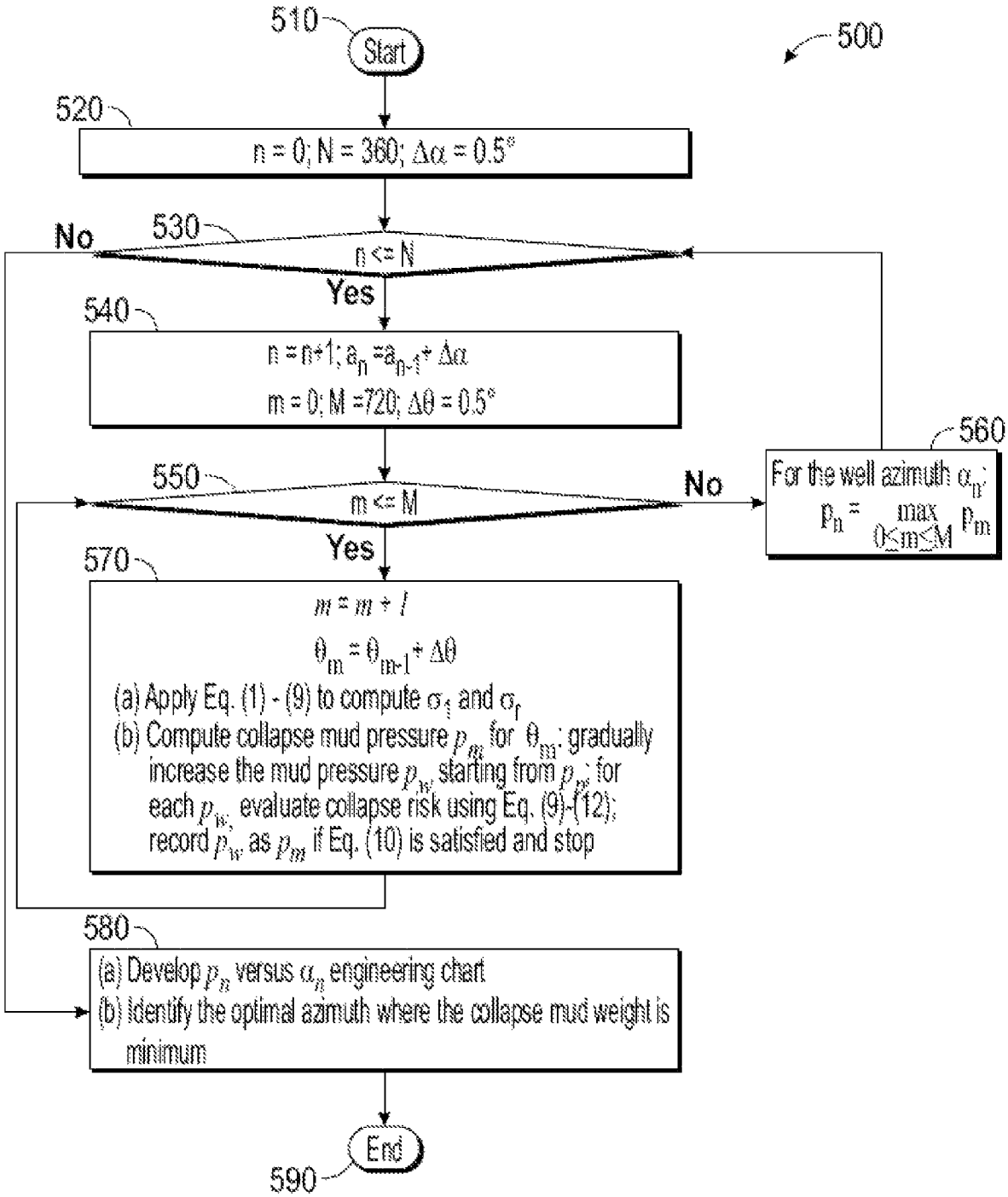
FIG. 5 shows an example of a process for determining an optimal direction for drilling a well in accordance with one or more embodiments.

FIG. 5 shows a flowchart 500 in accordance with one or more embodiments. Specifically, FIG. 5 shows an example of a process using the direction engine 200 to calculate the optimal direction 270. In some embodiments, the method may be implemented using the devices described in reference to FIG. 1. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Blocks 510-590, the direction engine 200 prepares the input parameters, including the in-situ stresses (i.e., the vertical stress, the maximum and the minimum horizontal stresses, and the pore pressure) and rock mechanical properties (e.g., Poisson's ratio, UCS, and Friction angle). In these blocks, the angle between the drilling direction and the maximum horizontal stress is increased from 1 to 180 degrees. For each angle a, the direction engine 200 calculates the minimum mud pressure required to prevent borehole collapse (collapse mud pressure), using equations (1)-(12). At this point, the collapse mud pressure (or mud weight) and the drilling angle are recorded. Finally, an engineering curve of collapse mud pressures (or mud weights) versus drilling angles is generated and an angle corresponding to the minimum drilling mud pressure (or mud weight) is calculated.

In Blocks 510-590, the direction engine 200 identifies an optimized well trajectory when drilling a horizontal well in the strike-slip stress box 310. In this example study, the gradients of in-situ stresses and pore pressure are as follows.

TVD=14,000 ft (foot), is a true vertical depth.

$S_v$=14.000 psi, is a vertical stress.

$S_H$=18.200 psi, is a maximum horizontal stress.

$S_h$=11.200 psi, is a minimum horizontal stress.

$p_p$=6.062 psi, is a pore pressure.

The rock mechanical properties are as follows:

ucs=10.000 psi, is an uniaxial compressive strength.

T=1.000 psi, is a tensile strength.

φ=35° (degrees), is a friction angle.

E=1.5 Mpsi, is Young's modulus.

v=0.22, is Poisson's ratio.

Figure 6:
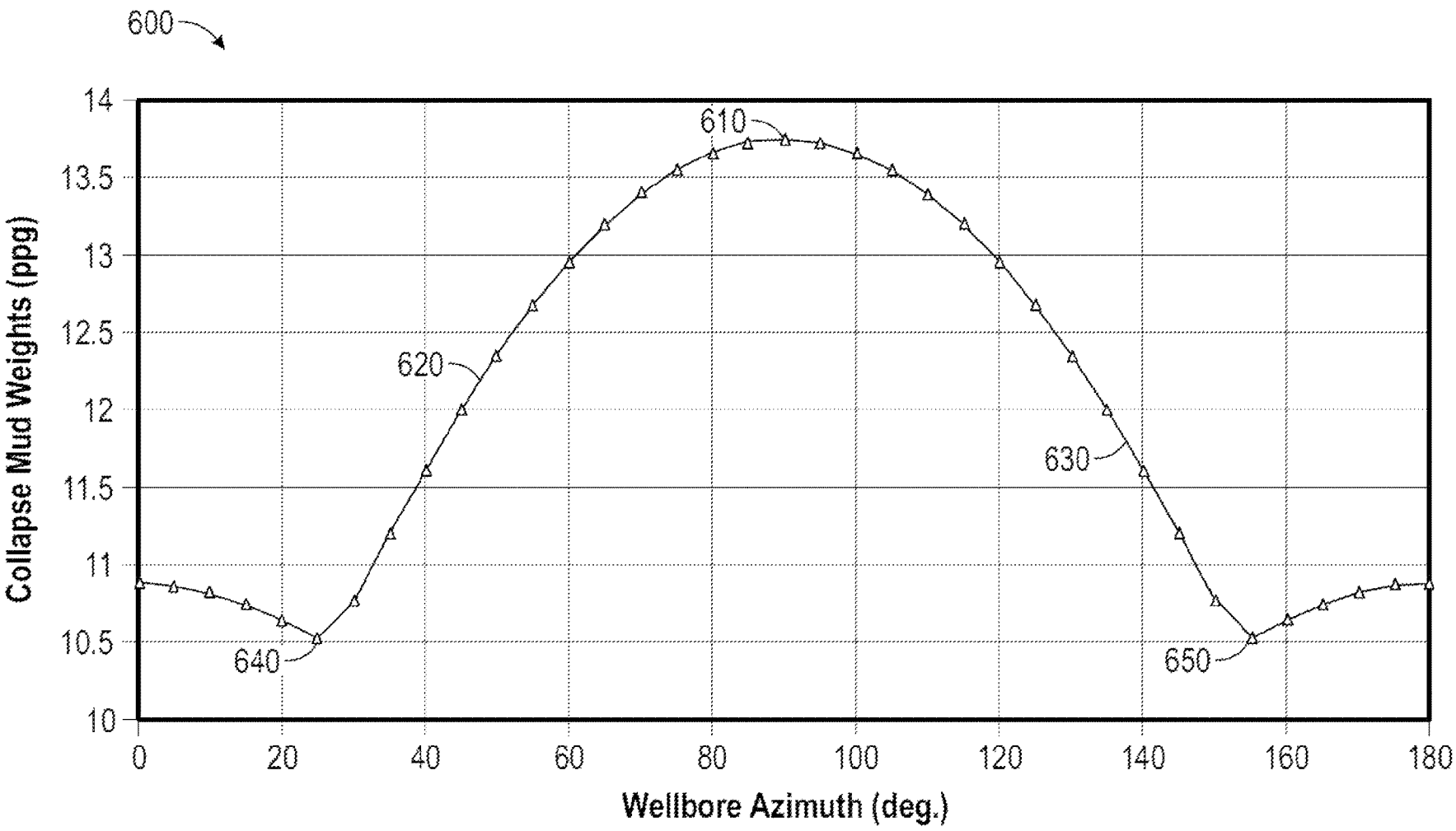
FIG. 6 shows a graph showing optimization results in accordance with one or more embodiments.

FIG. 6 shows an engineering curve 600 representing the relation between collapsed mud weights (measured in ppg) and the wellbore azimuth (measured in degrees). The engineering curve 600 includes results from the process followed in Blocks 510-590. The engineering curve 600 may be interpreted as an engineering chart of the collapse mud weights versus the tested drilling angles. As shown in FIG. 6, an ideal angle 640 corresponds to a minimum mud weight equal to about 25°. In this regard, to minimize the borehole collapse risk, the horizontal well is directed to be drilled at the angle of 25° from the maximum horizontal stress in a strike slip stress regime. The direction associated to the ideal angle 640 represents the optimal drilling direction for underbalanced coiled tubing drilling. A peak angle 610 is equal to 90°, and this peak angle 610 would not be identified as the optimal drilling direction because it would require the drilling operation with the highest mud weight and high drilling cost, as the drilling mud weights are not minimum. As indicated in FIG. 6, the ideal angle is at 640 or 650, which is equal to 25° or 155°, the two angles are mirror symmetric relative to the maximum horizontal stress direction.

Figure 7:
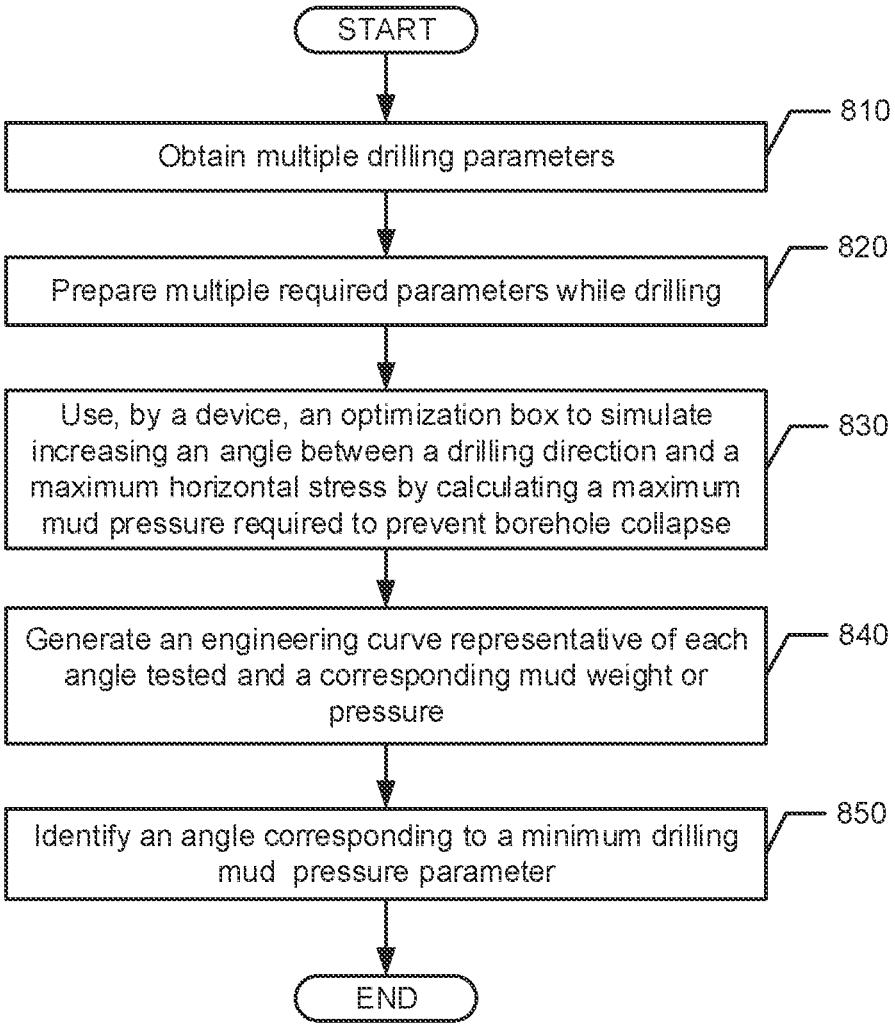
FIG. 7 shows a flowchart in accordance with one or more embodiments.

FIG. 7 shows a flowchart in accordance with one or more embodiments. Specifically, FIG. 7 describes a method for determining an optimal horizontal direction for drilling a horizontal well. In some embodiments, the method may be implemented using the devices described in reference to FIG. 1. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 810, the device 170 obtains multiple drilling parameters. The multiple drilling parameters may include maximum horizontal stress angle (azimuth), log data, true vertical depth at location (TVD) 170, pore pressure, etc., In Block 820, the device 170 prepares multiple required drilling parameters and includes calculation of in-situ stresses in global coordinate system. As noted above, these input parameters may include various in-situ stress and pore pressure parameters. Further, the input parameters may include rock mechanical properties such as the Poisson's ratio, the UCS, and the Friction angle.

In Block 830, the device 170 uses the optimization box 410 to simulate increasing an angle a between the drilling direction and the maximum horizontal stress direction by calculating the mud pressure required to prevent borehole collapse, and recording this value as the collapse mud pressure (i.e., the mud weight parameter) for each drilling angle between 0 and 180 degrees. During each iteration at each trial angle, the system will transform the in-situ stresses to the local coordinate at location 170, and then calculate the radial stress, tangential stress and axial stress in the surrounding wellbore at location 170.

In Block 840, the device 170 generates the engineering curve 600 using the results for each drilling angle.

In Block 850, the device 170 identifies an angle corresponding to the minimum drilling mud pressure parameter. This parameter is the optimal drilling direction to provide the smallest probability of a borehole collapse.

Figure 8:
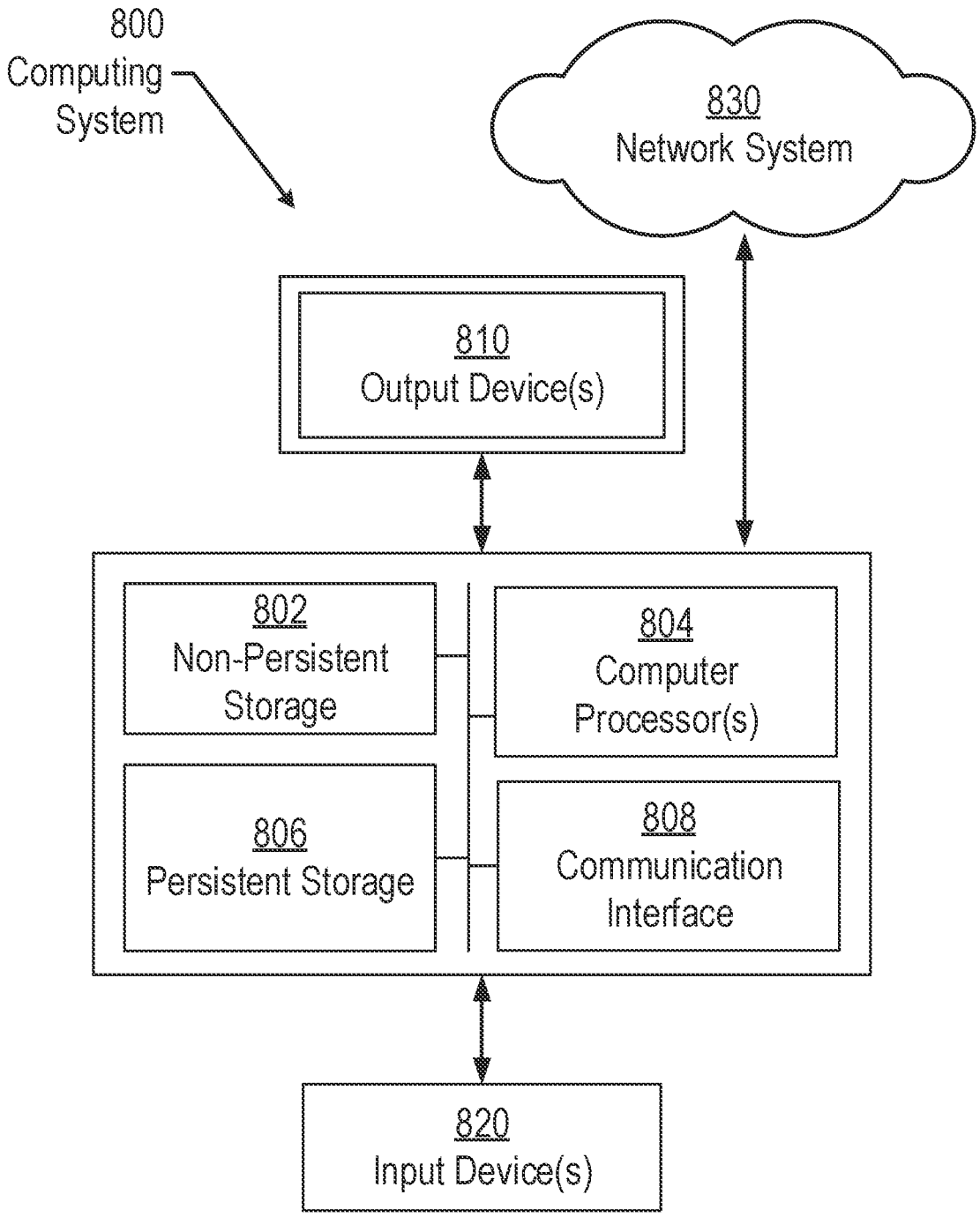
FIG. 8 shows an example of a computer system in accordance with one or more embodiments.

As shown in FIG. 8, the computing system 800 may include one or more computer processor(s) 804, non-persistent storage 802 (e.g., random access memory (RAM), cache memory, or flash memory), one or more persistent storage 806 (e.g., a hard disk), a communication interface 808 (transmitters and/or receivers) and numerous other elements and functionalities. The computer processor(s) 804 may be an integrated circuit for processing instructions. The computing system 800 may also include one or more input device(s) 820, such as a touchscreen, keyboard, mouse, microphone, touchpad, electronic pen, or any other type of input device. In some embodiments, the one or more input device(s) 820 may be the control system 130 connected to the device 170 described in reference to FIG. 1. Further, the computing system 800 may include one or more output device(s) 810, such as a screen (e.g., a liquid crystal display (LCD), a plasma display, or touchscreen), a printer, external storage, or any other output device. One or more of the output device(s) may be the same or different from the input device(s). The computing system 800 may be connected to a network system 830 (e.g., a local area network (LAN), a wide area network (WAN) such as the Internet, mobile network, or any other type of network) via a network interface connection (not shown).

In one or more embodiments, for example, the input device 820 may be coupled to a receiver and a transmitter used for exchanging communication with one or more peripherals connected to the network system 830. The receiver and the transmitter may receive/transmit information relating to information as described in reference to FIG. 2. The transmitter may relay information received by the receiver to other elements in the computing system 800. Further, the computer processor(s) 804 may be configured for performing or aiding in implementing the processes described in reference to FIGS. 2 and/or 5.

Further, one or more elements of the computing system 800 may be located at a remote location and be connected to the other elements over the network system 830. The network system 830 may be a cloud-based interface performing processing at a remote location from the well site and connected to the other elements over a network. In this case, the computing system 800 may be connected through a remote connection established using a 5G connection, such as protocols established in Release 15 and subsequent releases of the 3GPP/New Radio (NR) standards.

The computing system in FIG. 8 may implement and/or be connected to a data repository. For example, one type of data repository is a database. A database is a collection of information configured for ease of data retrieval, modification, re-organization, and deletion. In some embodiments, the databases include published/measured data relating to the method, the system, and the device as described in reference to FIGS. 1-7.

While FIGS. 1-8 show various configurations of components, other configurations may be used without departing from the scope of the disclosure. For example, various components in FIG. 1 may be combined to create a single component. As another example, the functionality performed by a single component may be performed by two or more components.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

The invention claimed is:

1. A system for drilling a well, comprising:

a device, as a portion of a conveyance mechanism, comprising a cylindrical housing with at least one sensor that tracks a position of the portion during a drilling operation, the device being configured to obtain a plurality of drilling parameters; and a control system coupled to the device and configured to perform at least one reservoir simulation, and prepare a plurality of required parameters while drilling, wherein the device uses an optimization strike slip stress box to simulate increasing multiple angles between a drilling direction and a maximum horizontal stress direction and calculate a value of minimum mud pressure required to prevent borehole collapse for each of the multiple angles, wherein the strike slip stress box simulation is an evaluation of a strike slip stress regime, and the strike slip stress regime meet the conditions of the maximum horizontal stress being larger than a vertical stress, which is in turn larger than a minimum horizontal stress, wherein the control system generates an engineering curve representative of each angle simulated and a corresponding value of minimum mud pressure, wherein the device and the control system identify an optimal direction corresponding to a minimum value of mud pressure from the engineering curve, and wherein the device includes a drill stabilizer section that instructs a drill bit to drill in the optimal direction deviating from the maximum horizontal stress direction for underbalanced drilling in the strike slip stress regime.

2. The system of claim 1, wherein the plurality of required parameters while drilling are in-situ stresses in borehole local coordinates.

3. The system of claim 1, wherein the plurality of drilling parameters comprise calculation of in-situ stresses in global coordinate system, and maximum horizontal stress angle (azimuth) and reservoir pore pressure, wherein the plurality of drilling parameters are used to calculate a radial stress, a tangential stress, an axial stress, and a shear stress at a location in a borehole local coordinate system.

4. The system of claim 1, wherein the angle between the drilling direction and the maximum horizontal stress direction is increased from 0 degrees to 180 degrees for each optimization strike slip stress box simulation.

5. The system of claim 1, wherein the well is a horizontal well.

6. A method for drilling a horizontal well, comprising:

obtaining, by a device, a plurality of drilling parameters, wherein the device, as a portion of a conveyance mechanism, comprises a cylindrical housing with at least one sensor that tracks a position of the portion during a drilling operation, preparing, by a control system, a plurality of required parameters while drilling, wherein the control system is coupled to the device and configured to perform at least one reservoir simulation, using, by the device, an optimization strike slip stress box to simulate multiple angles between a drilling direction and a maximum horizontal stress direction and calculate a value of minimum mud pressure required to prevent borehole collapse for each of the multiple angles, wherein the strike slip stress box simulation is an evaluation of a strike slip stress regime, and the strike slip stress regime meet the conditions of the maximum horizontal stress being larger than a vertical stress, which is in turn larger than a minimum horizontal stress, generating, by the control system, an engineering curve representative of each angle simulated and a corresponding value of minimum mud pressure, identifying, by the device and the control system, an optimal direction corresponding to a minimum value of mud pressure from the engineering curve, and instructing, by a drill stabilizer section of the device, a drill bit to drill in the optimal direction deviating from the maximum horizontal stress direction for underbalanced drilling in the strike slip stress regime.

7. The method of claim 6, wherein the plurality of required parameters while drilling are in-situ stresses in borehole local coordinates.

8. The method of claim 6, wherein the plurality of drilling parameters comprise calculation of in-situ stresses in global coordinate system, and maximum horizontal stress angle (azimuth) and reservoir pore pressure, wherein the plurality of drilling parameters are used to calculate a radial stress, a tangential stress, an axial stress, and a shear stress at a location in a borehole local coordinate system.

9. The method of claim 6, wherein the angle between the drilling direction and the maximum horizontal stress direction is increased from 0 degrees to 180 degrees every time the optimization strike slip stress box is used.

10. A non-transitory computer readable medium storing instructions executable by a computer processor, the instructions comprising functionality for:

obtaining, by a device, a plurality of drilling parameters;

wherein the device is a portion of a conveyance mechanism and comprises a cylindrical housing with at least one sensor that tracks a position of the portion during a drilling operation;

preparing, by a control system, a plurality of required parameters while drilling;

wherein the control system is coupled to the device and configured to perform at least one reservoir simulation;

using, by the device, an optimization strike slip stress box to simulate multiple angles between a drilling direction and a maximum horizontal stress direction and calculate a value of minimum mud pressure required to prevent borehole collapse for each of the multiple angles, wherein the strike slip stress box simulation is an evaluation of a strike slip stress regime, and the strike slip stress regime meet the conditions of the maximum horizontal stress being larger than a vertical stress, which is in turn larger than a minimum horizontal stress, generating, by the control system, an engineering curve representative of each angle simulated and a corresponding value of minimum mud pressure, identifying, by the device and the control system, an optimal direction corresponding to a minimum value of mud pressure from the engineering curve; and instructing, by a drill stabilizer section of the device, a drill bit to drill in the optimal direction deviating from the maximum horizontal stress direction for underbalanced drilling in the strike slip stress regime.

11. The non-transitory computer readable medium of claim 10, wherein the plurality of required parameters while drilling are in-situ stresses in borehole local coordinates.

12. The non-transitory computer readable medium of claim 10, wherein the plurality of drilling parameters comprise calculation of in-situ stresses in global coordinate system, and maximum horizontal stress angle (azimuth) and reservoir pore pressure, wherein the plurality of drilling parameters are used to calculate a radial stress, a tangential stress, an axial stress, and a shear stress at a location in a borehole local coordinate system.

13. The non-transitory computer readable medium of claim 10, wherein the angle between the drilling direction and the maximum horizontal stress is increased from 1 degree to 180 degrees every time the optimization strike slip stress box is used.

14. The non-transitory computer readable medium of claim 10, wherein the drilling is for a horizontal well.

* * * * *